US010724807B2

(12) United States Patent
Okubo et al.

(10) Patent No.: US 10,724,807 B2
(45) Date of Patent: Jul. 28, 2020

(54) HEAT EXCHANGER AND METHOD FOR ASSEMBLING SAME

(71) Applicant: T.RAD Co., Ltd., Shibuya-ku, Tokyo (JP)

(72) Inventors: Atsushi Okubo, Tokyo (JP); Taiji Sakai, Tokyo (JP); Takuya Bungo, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 102 days.

(21) Appl. No.: 15/768,997

(22) PCT Filed: Oct. 17, 2016

(86) PCT No.: PCT/JP2016/081377
§ 371 (c)(1),
(2) Date: Apr. 17, 2018

(87) PCT Pub. No.: WO2017/069280
PCT Pub. Date: Apr. 27, 2017

(65) Prior Publication Data

US 2018/0306527 A1 Oct. 25, 2018

(30) Foreign Application Priority Data

Oct. 22, 2015 (JP) ..... 2015-208149

(51) Int. Cl.
*F28F 9/02* (2006.01)
*F28F 21/06* (2006.01)
(Continued)

(52) U.S. Cl.
CPC ..... *F28F 9/0226* (2013.01); *F28F 1/16* (2013.01); *F28F 9/002* (2013.01); *F28F 9/12* (2013.01);
(Continued)

(58) Field of Classification Search
CPC .. F28F 9/0226; F28F 9/002; F28F 9/12; F28F 1/16; F28F 21/067; F28F 9/18; F28F 2275/122
See application file for complete search history.

(56) References Cited

U.S. PATENT DOCUMENTS 4,997,035 A * 3/1991 Beatenbough ..... F28F 9/0226 165/149
6,892,804 B2 * 5/2005 Nozaki ..... F02B 29/0456 165/173
(Continued)

FOREIGN PATENT DOCUMENTS

CN 104791487 A 7/2015
DE 10 2004 033784 A1 2/2006
(Continued)

*Primary Examiner* — Tho V Duong
(74) *Attorney, Agent, or Firm* — Norris McLaughlin, P.A.

(57) ABSTRACT

A packing is held between a tank body and a header plate to secure sealing. Therewith, the width in a longer axis direction of an opening of a flat tube is wider and the width of the tank body is relatively narrow, resulting in a compact tank structure. A number of tooth parts protrude from the tank body at regular intervals, a tube end release part is formed between the tooth parts, and a side edge in a longitudinal axis direction of an opening of the flat tube is positioned therein. The tooth part, a flange part, a seal face of the header plate and a peripheral wall form a packing accommodation part, and a tip edge of the tooth part is seated on an edge of a convex part. The packing is arranged between the packing accommodation part and the seal face.

6 Claims, 12 Drawing Sheets

(51) Int. Cl.

| | |
|---|---|
| ***F28F 1/16*** | (2006.01) |
| ***F28F 9/00*** | (2006.01) |
| ***F28F 9/12*** | (2006.01) |
| *F28F 9/18* | (2006.01) |

(52) U.S. Cl.
CPC ..... *F28F 21/067* (2013.01); *F28F 9/18* (2013.01); *F28F 2275/122* (2013.01)

(56) References Cited

U.S. PATENT DOCUMENTS

| | | | | |
|---|---|---|---|---|
| 7,775,226 | B2 * | 8/2010 | MacDonald | A45B 11/02 135/29 |
| 7,775,266 | B2 | 8/2010 | Freitag et al. | |
| 8,181,694 | B2 * | 5/2012 | Powers | F28F 9/0226 165/149 |
| 2006/0144579 | A1 | 7/2006 | Ozaki | |
| 2008/0135220 | A1 | 6/2008 | Aksoy et al. | |
| 2013/0299149 | A1 * | 11/2013 | Riondet | F28F 9/0226 165/173 |
| 2016/0258693 | A1 | 9/2016 | Mabuchi et al. | |
| 2017/0038163 | A1 | 2/2017 | Hakamata et al. | |

FOREIGN PATENT DOCUMENTS

| | | | | |
|---|---|---|---|---|
| DE | 102010033850 | A1 | 2/2012 | |
| EP | 2455697 | A1 * | 5/2012 | F28F 9/0226 |
| JP | 62-204185 | U | 12/1987 | |
| JP | 2002-195781 | A | 7/2002 | |
| JP | 2006-189206 | A | 7/2006 | |
| JP | 2015-087055 | A | 5/2015 | |
| JP | 2015-127631 | A | 7/2015 | |
| JP | 2015127631 | A * | 7/2015 | F28F 9/0226 |
| WO | WO-2005088224 | A1 * | 9/2005 | F28F 9/0226 |

* cited by examiner

HEAT EXCHANGER AND METHOD FOR ASSEMBLING SAME

BACKGROUND OF THE INVENTION

The present invention relates to a heat exchanger including a resin tank body, a header plate and a packing, in particular relates to an assembly structure of a tank and a header plate capable of reducing a tank width to make the tank compact.

In a heat exchanger described in Japanese Patent Laid-Open No. 2006-189206 and Japanese Patent Laid-Open No. 2015-87055, a flange part is provided in a protruding state for an outer periphery of a resin tank and an edge face of the flange part is fitted, over the whole length, into an annular groove of a header plate via a packing. FIG. 15 illustrates a transverse sectional view showing a state where the resin tank is mounted to the header plate.

In a heat exchanger described in Japanese Patent Laid-Open No. 2015-87055, an annular groove of a header plate is made as small as possible, and an end part of a resin tank is fitted into the annular groove via a packing. On an inner face side of the tank, the transverse section thereof is formed in a wavelike shape and, between concave parts of the wave, a flat tube is arranged.

SUMMARY OF THE INVENTION

The heat exchanger described in Japanese Patent Laid-Open No. 2006-189206 has, as shown in FIG. 15, such a weakness that the flange part of the tank is always subjected to a force in a floating direction by the packing such as to result in unstable positioning of the tank body and the header plate.

Next, the heat exchanger described in Japanese Patent Laid-Open No. 2015-87055 is provided with a packing groove that is made as thin as possible and a lower end of the resin tank is abutted thereon, and has such a weakness that reliability on pressure tightness of seal and the like is unsure.

Therefore, the present invention aims at solving these problems.

A first aspect of the invention described is a heat exchanger comprising:

a header plate (1) including tube insertion holes (2) disposed in parallel spaced from each other in a longitudinal direction and, to the tube insertion hole (2), an end part of a flat tube (3) is inserted; and a resin tank body (5) fixed to the header plate (1) via an annular packing (7), wherein:

the header plate (1) includes a bottom part (1*c*) provided with a seal face (la) with which the packing (7) makes contact and an insertion hole drilling face (1*b*) for which the tube insertion hole (2) is provided, and a peripheral wall (8) extended upward from an outer peripheral edge of the bottom part (1*c*) with a caulking claw (9) formed at an edge part of the bottom part (1*c*);

for the insertion hole drilling face (1*b*) of the bottom part (1*c*), a convex part (4) protruding in the extending direction of the peripheral wall (8) is provided in a range not exceeding an opening (3*b*) of the flat tube (3);

the tank body (5) includes:

a flange part (6) provided for an opening of the tank body (5), and a number of tooth parts (10) protruding from an end face (6*a*) of the flange part (6) along an inner periphery of the flange part (6), being spaced from each other and facing the seal face (la) of the header plate (1);

a tube end release part (11) formed between the tooth parts (10) and recessed so that a side edge (3*a*) in a longer axis direction of an opening of the flat tube (3) is disposed on a peripheral wall (8) side than an inner periphery of the tooth part (10); and a packing accommodation part (12) formed among an outer side face (10*a*) of each tooth part (10) and the end face (6*a*) of the flange part (6) and an inner peripheral face of the peripheral wall (8);

an inside tip edge (10*b*) of the tooth part (10) is seated on an outer peripheral side edge (4*a*) of the convex part (4); and the packing (7) is arranged between the packing accommodation part (12) and the seal face (la), and the tank body (5) is fixed to the header plate (1) by the caulking claw (9).

A second aspect of the invention is the heat exchanger according to the first aspect, wherein the convex part (4) is a planar convex part spreading over the whole of the insertion hole drilling face (1*b*).

A third aspect of the invention is the heat exchanger according to the first aspect, wherein the convex part (4) is a linear projection extending in a parallel direction of the tube insertion holes (2).

A fourth aspect of the invention is the heat exchanger according to the first aspect, wherein the convex part (4) is a linearly extending projection between the tube insertion holes (2).

A fifth aspect of the invention is the heat exchanger according to any of the first to fourth aspects, wherein a gap (101) is present between the side face (10*a*) of the tooth part (10) and the packing (7).

A sixth aspect of the invention is the heat exchanger according to any of the first to fourth aspects, wherein the packing (7) is positioned while contacting the side face (10*a*) of the tooth part (10).

A seventh aspect of the invention is the heat exchanger according to the fifth aspect, wherein the annular packing (7) is positioned while contacting the side edge (3*a*) in a longer axis direction of an opening of the flat tube (3).

An eighth aspect of the invention is the heat exchanger according to the fifth aspect, wherein a hole edge of the tube insertion hole (2) of the header plate (1) is formed with respect to a rim wall (13) extended upward on the tank body (5) side, and, at an side edge on a longer axis side of the burring processing part (13), the annular packing (7) is positioned.

A ninth aspect of the invention is the heat exchanger according to the sixth aspect, wherein a hole edge of the tube insertion hole (2) of the header plate (1) is formed with respect to a rim wall (13) extended upward on the tank body (5) side, and, at an side edge on a longer axis side of the rim wall (13), the annular packing (7) is positioned.

A tenth aspect of the invention is the heat exchanger according to any of the first to ninth aspects, wherein, in the tube end release part (11) between the tooth parts (10), a transverse section thereof is hollowed out gradually in a "J-like" shape without a head part toward the packing (7) side.

In the configuration according to the tenth aspect, "J-like" shape relates to the shape of cross-section of the tube end release part 11 of the right side wall of the tank body 5 in FIG. 2 (a tank body illustrated in an upper portion), and in the left side wall, the shape appears as the mirror image of the right side wall. Moreover, in the lower portion tank body 5, the direction of the letter "J" appears in a vertically reversed direction as compared with the shape in FIG. 2. Furthermore, the letter "J" is differently expressed as a shape of half bow. That is, it is a shape of upper half from the center of a bow.

An eleventh aspect of the invention is a method for assembling the heat exchanger according to either the sixth aspect or the ninth aspect, comprising the steps of:

mounting the annular packing (7), in a stretched state in a circumferential direction, onto the side face (10*a*) of the tooth part (10) of the tank body (5), and, in the state, fitting an opening part of the tank body (5) into the seal face (la) of the header plate (1) with the packing (7); and subsequently, caulking and fixing the tank body (5) with the caulking claw (9) of the peripheral wall (8) of the header plate (1).

The heat exchanger of the first aspect includes the number of tooth parts 10 that protrude separately along the inner periphery of the tank body 5, the tube end release part 11 formed between the tooth parts 10, and the packing accommodation part 12 formed between each tooth part 10, the end face 6*a* of the flange part 6 of the tank body 5 and the peripheral wall 8 of the header plate 1, in which the tip edge 10*b* of the tooth part 10 contacts the edge 4*a* of a convex part 4 of the header plate 1, and the packing 7 is arranged between the packing accommodation part 12 and the seal face 1*a* of the header plate 1.

Further, it has such a structure that the side edge 3*a* on the longer axis side of the flat tube 3 is inserted into the tube end release part 11 formed in a recessed state between the tooth parts 10 of the tank body 5.

Consequently, the side edge 3*a* of the flat tube 3 can be set, shifted to the peripheral wall 8 side than the edge 4*a* of the convex part 4 of the header plate 1. As the result, it is possible to make the width of the tank body 5 small, and to actualize decrease in size of a heat exchanger.

In addition, the tip edge 10*b* of the tooth part 10 is seated on the edge 4*a* on the seal face 1*a* side of the convex part 4 to secure the positioning between the tank body 5 and the header plate 1, and give a structure with high pressure tightness. Furthermore, the packing accommodation part 12 is secured among the side face 10*a* of the tooth part 10, the end face 6*a* of the flange part 6 and the peripheral wall 8, and sealing performance of the tank can be made good.

As an example of the convex part 4, shapes according to the second to fourth aspects can be adopted.

In particular, in the third aspect of the invention, the convex part 4 is set to a linear projection extending in a parallel direction of tube insertion holes, and, as a result of the effect of a rib provided on a flat face, it is possible to enhance rigidity of the header, and also to enhance strength of a junction part of the tube and the header.

In the fifth aspect of the invention, in the above-described configuration, the gap 101 is provided between the side face 10*a* of the tooth part 10 of the tank body 5 and the annular packing 7, and, therefore, it is possible to prevent the tooth part 10 from running on the packing 7, and to give good sealing performance.

In the sixth aspect of the invention described, in the above-described configuration, the annular packing 7 contacts the side face 10*a* of the tooth part 10 of the tank body 5 and the packing 7 is positioned, and, therefore, it is possible to place the packing 7 accurately on the seal face 1*a*, and to assure the sealing performance of the tank.

In the seventh aspect of the invention, in the configuration according to the fifth aspect, the annular packing 7 is positioned while contacting the side edge 3*a* in the longer axis direction of the opening of the flat tube 3, and, therefore, the packing 7 is reliably held to give a structure of good sealing performance.

In the eighth aspect of the invention, in the configuration according to the fifth aspect, the rim wall 13 is formed, extended upward from the hole edge of a tube insertion hole 2 of the header plate 1 and the annular packing 7 is positioned at the side edge on the longer axis side of the rim wall 13, and, therefore, the packing 7 is positioned at the side edge of the rim wall 13 to enable the packing 7 to be held stably, and the insertion end part of the flat tube 3 is protected by the rim wall 13.

In the ninth aspect of the invention, in the configuration according to the sixth aspect, the rim wall 13 is formed, extended upward from the hole edge of the tube insertion hole 2 of the header plate 1, and the annular packing 7 is positioned at the side edge on the longer axis side of the rim wall 13. Therefore, the positioning of the packing 7 can easily be performed, and the insertion end part of the flat tube 3 can be protected by the rim wall 13.

In the tenth aspect of the invention, in any of above-described configurations, the inner face side of the transverse section of the tube end release part 11 lying between the tooth parts 10 is formed so that the transverse section has a "J-like" shape without the head part toward a packing side, and, therefore, decline of strength of the tank body due to decrease in the wall thickness can be reduced.

The eleventh aspect of the invention described includes, in the configuration according to either the sixth aspect or the ninth aspect, the step of stretching the annular packing 7 in the circumferential direction and mounting the same onto the side face 10*a* of the tooth part 10 of the tank body 5, and fitting, with the packing 7 in the state, the opening of the tank body 5 into the seal face 1*a* of the header plate 1, and, therefore, the packing 7 can quickly and accurately be fitted into the packing accommodation part 12.

DETAILED DESCRIPTION OF THE INVENTION

Figure 1:
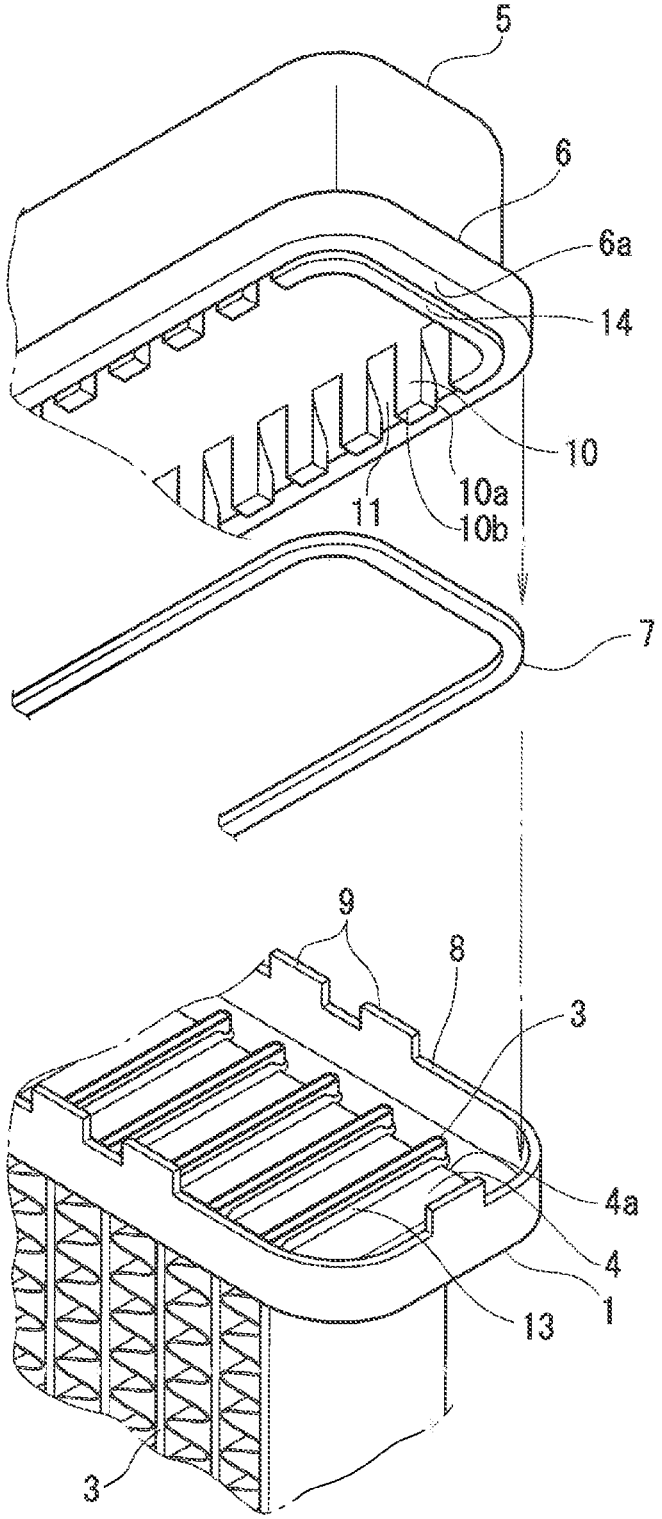
FIG. 1 illustrates an exploded perspective view of a main part of a heat exchanger in a first Example of the present invention.

Next, the heat exchanger of the present invention is explained referring to the drawings.

Example 1

FIGS. 1-6 show a first Example of the present invention.

In the heat exchanger, as shown in FIG. 1, a number of flat tubes 3 are disposed in parallel, and the end part of both openings 3*b* of the flat tube 3 is inserted into a tube insertion hole 2 drilled in parallel in a longitudinal direction of a pair of header plates 1 (a tank on a lower side is omitted). Then, a corrugated fin is arranged between each tube 3 to form a core, and respective components of the core are integrally brazed in a high temperature furnace. A brazing material is, in advance, applied between each component or coated to members.

The header plate 1 is formed by press molding of a plate of metal (such as aluminum, aluminum alloy or stainless steel) and has a plate-like shape with a peripheral wall 8 extended upward at the outer peripheral edge of a bottom part 1*c* of the plate. At a tip edge of the peripheral wall 8, a caulking claw 9 is separately provided in a protruding state. For the bottom face 1*c* of each header plate 1, an insertion hole drilling face 1*b* in which the tube insertion hole 2 is drilled, and a seal face 1*a*, a packing being placed between an outer periphery thereof and the peripheral wall 8, are provided.

In a state where the packing 7 is placed on the seal face 1*a*, the tank body 5 is fitted thereto. The tank body 5 has a flange part 6 formed by injection molding of resin, and, by the caulking claw 9 provided in a protruding state for a peripheral edge, the tank body 5 is fixed to the core.

Here, the present invention is characterized by an assembling structure of the resin tank body 5 and the header plate 1. The tank body 5 is formed into an approximately square box-like shape with one opened face, and, at the outer periphery of the opened end, the flange part 6 is formed annularly. Therewith, as illustrated in FIGS. 1-4, a number of tooth parts 10 are provided in a protruding state along the inner peripheral face on an inner face side of the tank body.

The tooth part 10 protrudes from an end face 6*a* of the flange part 6 of the tank body 5, and at both ends in a longitudinal direction of the tank body 5, a pair of arc-like tooth parts 14 (left side is omitted) are provided in a protruding state. The length of each tooth part 10 and the protruding length of a pair of the arc-like tooth parts 14 from the end face 6*a* are identical.

Figure 2:
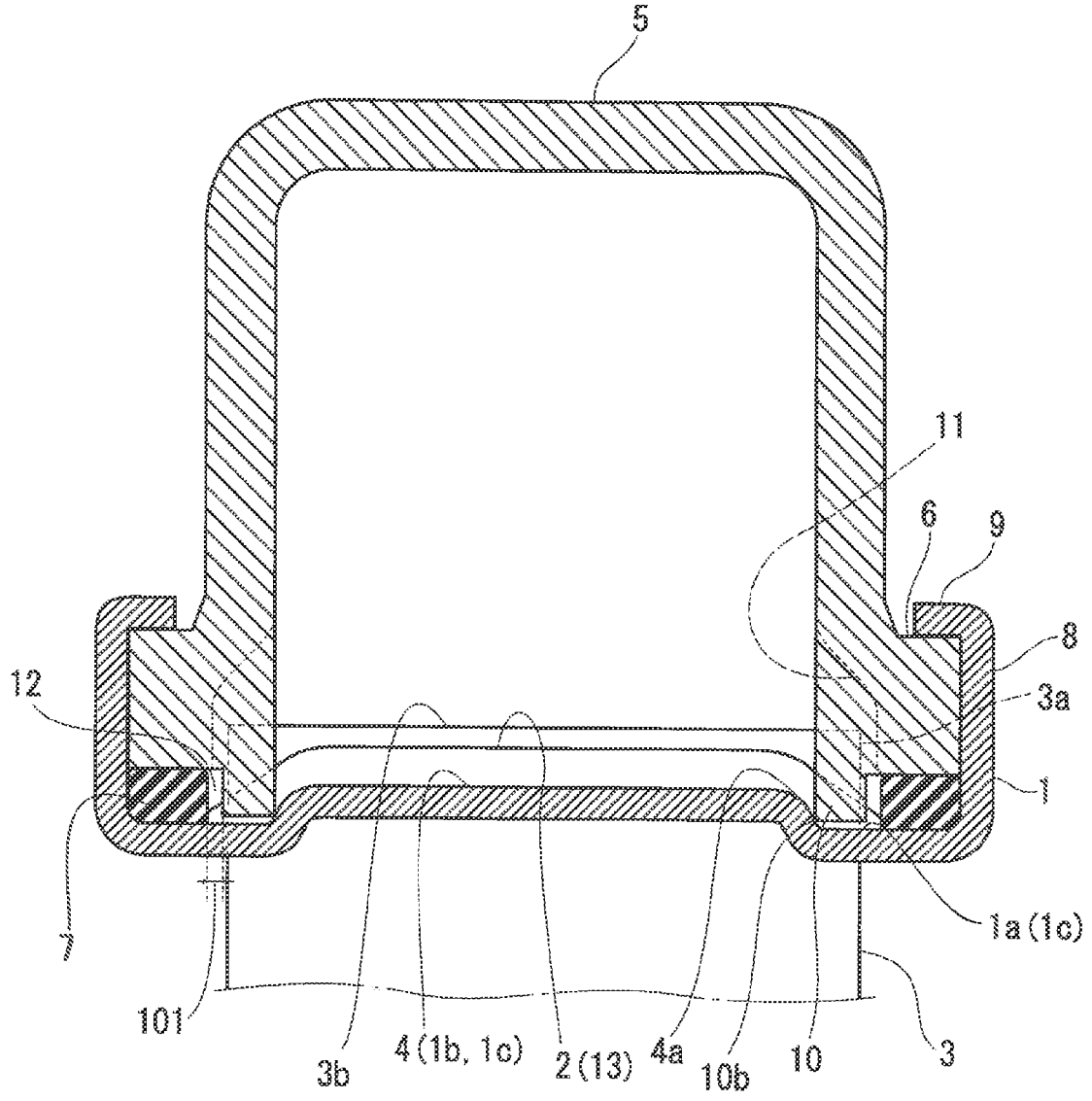
FIG. 2 illustrates a transverse sectional view of the main part.
Figure 3:
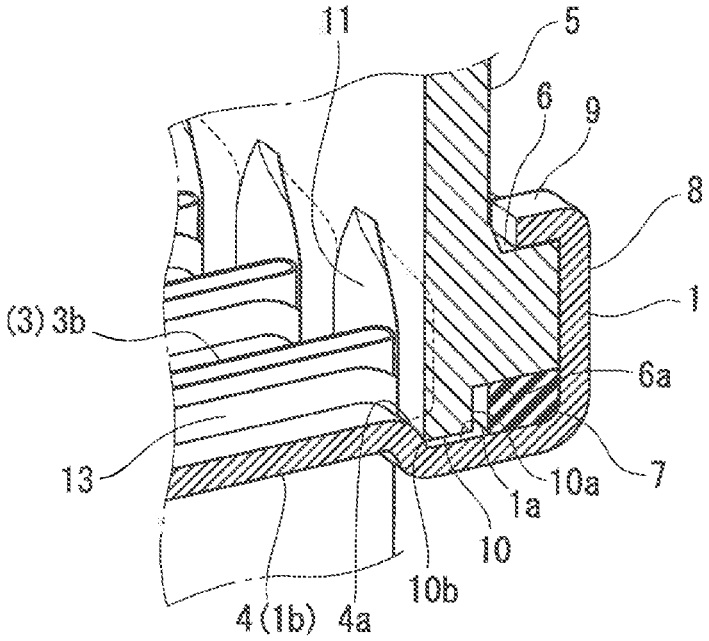
FIG. 3 illustrates a perspective view of the main part.
Figure 4:
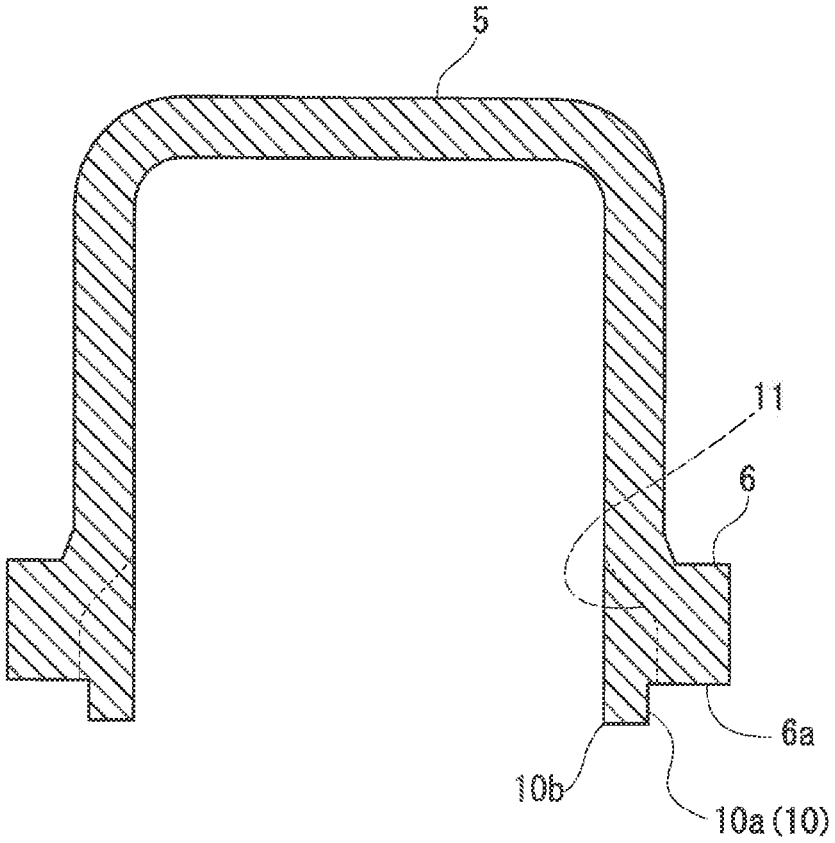
FIG. 4 illustrates a transverse sectional view of a tank body 5 for use in the heat exchanger.

That is, in the end face 6*a* of the tank body 5 and a side face 10*a* on the outer side of the tooth part 10, as illustrated in FIGS. 2 and 3, the transverse section in the width direction of the tank body 5 forms an L-shaped step.

Between these respective tooth parts 10, a tube end release part 11 is formed in a recessed state so as to match the position of the tube insertion hole 2 with respect to the flat tube 3. The tube end release part 11 is recessed, as illustrated in FIGS. 1-3, toward the end face 6*a* of the flange part 6, so that the transverse section in the width direction of the tank body 5 is in a reverse "J-like" shape without the head part.

Figure 5:
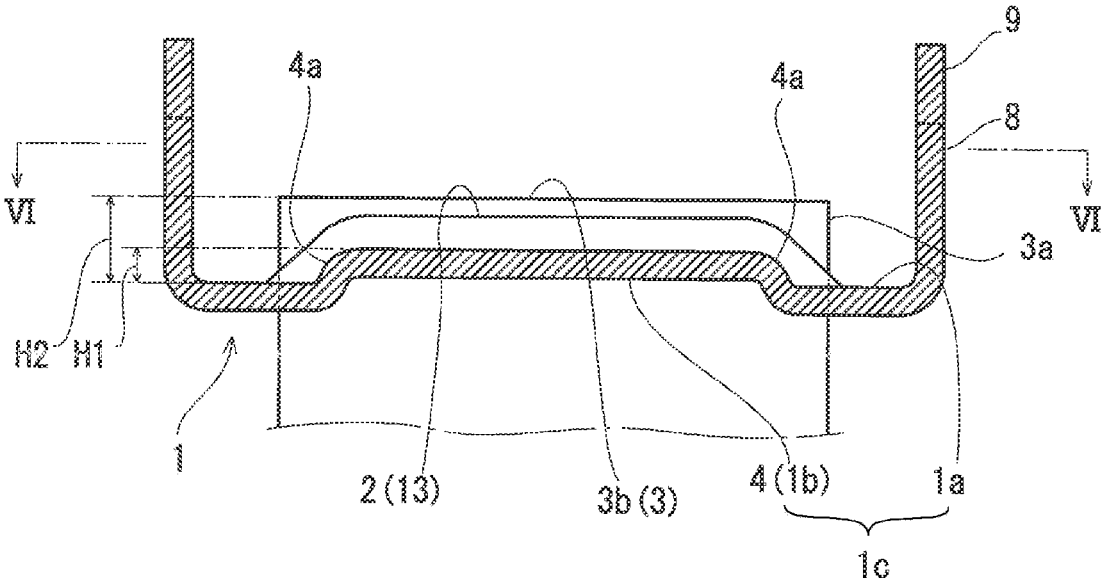
FIG. 5 illustrates a transverse sectional view of a header plate 1 for use in the heat exchanger.
Figure 6:
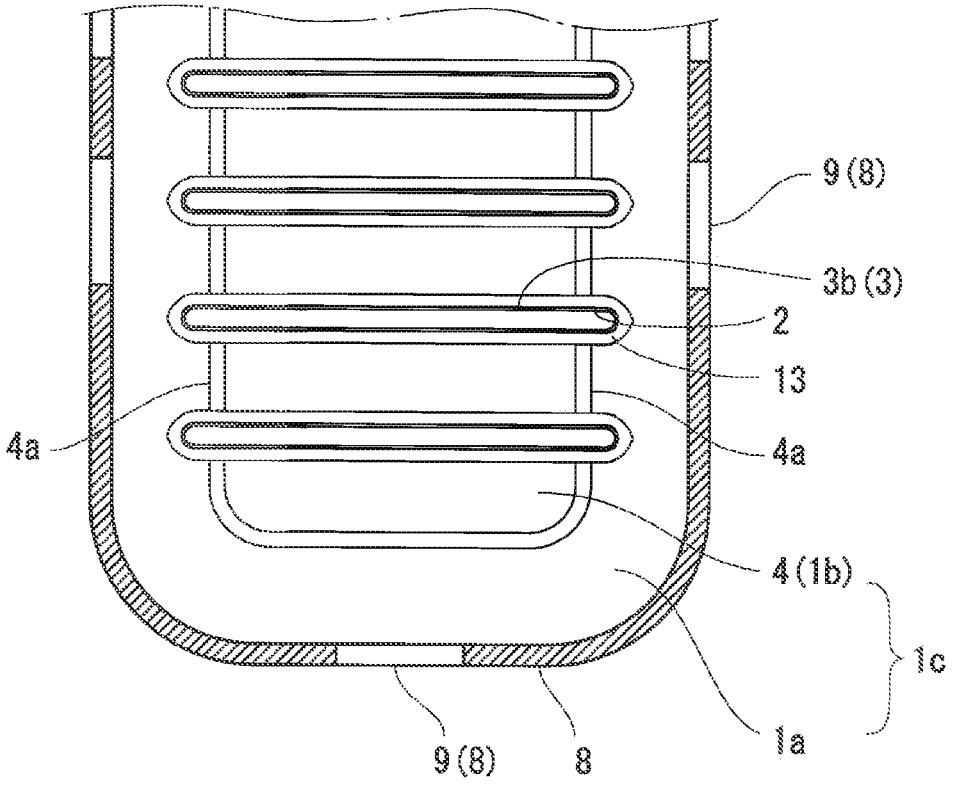
FIG. 6 illustrates a main part plan view seen along a VI-VI arrow in FIG. 5.

Next, to the header plate 1, as illustrated in FIGS. 5 and 6, the tube insertion holes 2 are drilled at a constant interval so as to be in parallel in the longitudinal direction of the insertion hole drilling face 1*b* of the bottom face 1*c* thereof. At the hole edge part of the tube insertion hole 2, a rim wall 13 extended upward toward the extending direction of the peripheral wall 8 of the header plate 1 is formed. Further, at a position adjacent to each tube insertion hole 2, a convex part 4 is provided in a protruding state toward the extended upward direction of the peripheral wall 8. Furthermore, as illustrated in FIG. 2, it is configured so that a tip edge 10*b* of the tank body 5 abuts on an edge 4*a* on the outer side of the convex part 4.

In the example in FIGS. 1-6, the convex part 4 has a shape that rises in a planar state from the inner face bottom part 1*c* of the header plate 1 over the whole of the insertion hole drilling face 1*b*. Protruding height H1 from the inner face bottom part 1*c* of the header plate 1 is formed, as illustrated in FIG. 5, so as not to exceed height H2 from the inner face bottom part 1*c* to an opening end part into which the flat tube 3 is inserted.

As the result of disposing the convex part 4, it is possible to position the tooth part 10 of the tank body 5, and to prevent lateral slip of the tank body 5. Moreover, as the result of disposing the rim wall 13, it is possible to prevent deformation of the end part of the flat tube 3 due to, when an external force is applied to the tank body 5, direct propagation of the external force to an insertion end part of the flat tube 3.

In the example, between the edge 4*a* on the outer side of the convex part 4 and the peripheral wall 8 of the header plate 1, the annular and groove-shaped seal face 1*a* is formed.

When the resin tank body 5 is assembled to such a core of a heat exchanger, in advance, the annular packing 7 is arranged to the seal face 1*a* of the header plate 1. At this time, the inner periphery of the packing 7 abuts on a side edge on a longer axis side of the rim wall 13 to position the packing 7.

Subsequently, the tank body 5 is fitted onto the header plate 1. The end face 6*a* of the flange part 6 of the tank body 5 is placed onto the seal face 1*a* via the packing 7. On this occasion, as illustrated in FIG. 2, the tooth part 10 of the tank body 5 and the tip edge 10*b* on the inner side of the arc-shaped tooth part 14 abut on the edge 4*a* on the outer side of the convex part 4 of the header plate 1 to position the tank body 5.

At this time, such a structure is given that the groove-shaped seal face 1*a*, the peripheral wall 8, the side face 10*a* of the tooth part 10, and the end face 6*a* of the flange part 6 form the annular packing accommodation part 12 and the packing 7 is arranged to the packing accommodation part 12.

A side edge on the long axis side of the rim wall 13 is formed so as to protrude from the side face 10*a* on the outer side of the tooth part 10 of the tank body 5, and, therefore, between the side face 10*a* on the outer side of the tooth part of the tank body 5 and the inner periphery of the packing 7, a gap 101 is generated. Consequently, it is possible to prevent the tooth part 10 from running on the packing 7, and to keep good sealing performance.

Moreover, as is clear from FIGS. 2 and 3, each flat tube 3 is inserted into the tube insertion hole 2 of the rim wall 13 of the header plate 1, and the side edge 3*a* is put into the tube end release part 11 between respective tooth parts 10. Consequently, the side edge 3*a* in the longer axis direction of the opening 3*b* of the flat tube 3 is caused to protrude on the peripheral wall 8 side. Further, the side edge 3*a* is positioned on the peripheral wall 8 side than the tip edge 10*b* of the tooth part 10 of the tank body 5. As the result, the width of the peripheral wall 8 is reduced to give a compact structure.

Subsequently, in the state, the caulking claw 9 at the end part of the peripheral wall 8 of the header plate 1 is caulked to the flange part 6 side of the tank body 5, the tank body 5 is fixed to the core to complete a heat exchanger. At this time, the packing 7 is pressed to the seal face 1*a* side to form a watertight structure.

In the drawings, portions that give characteristics of the present application are illustrated with emphasis, and, therefore, necessary portions such as a fluid inlet/outlet port for allowing a fluid to flow into the inside of the tank of the heat exchanger are omitted. These are formed at the same time as the tank body 5 upon resin-molding the tank body 5.

Example 2

FIGS. 7-11 illustrate a second Example of the present invention.

Figure 7:
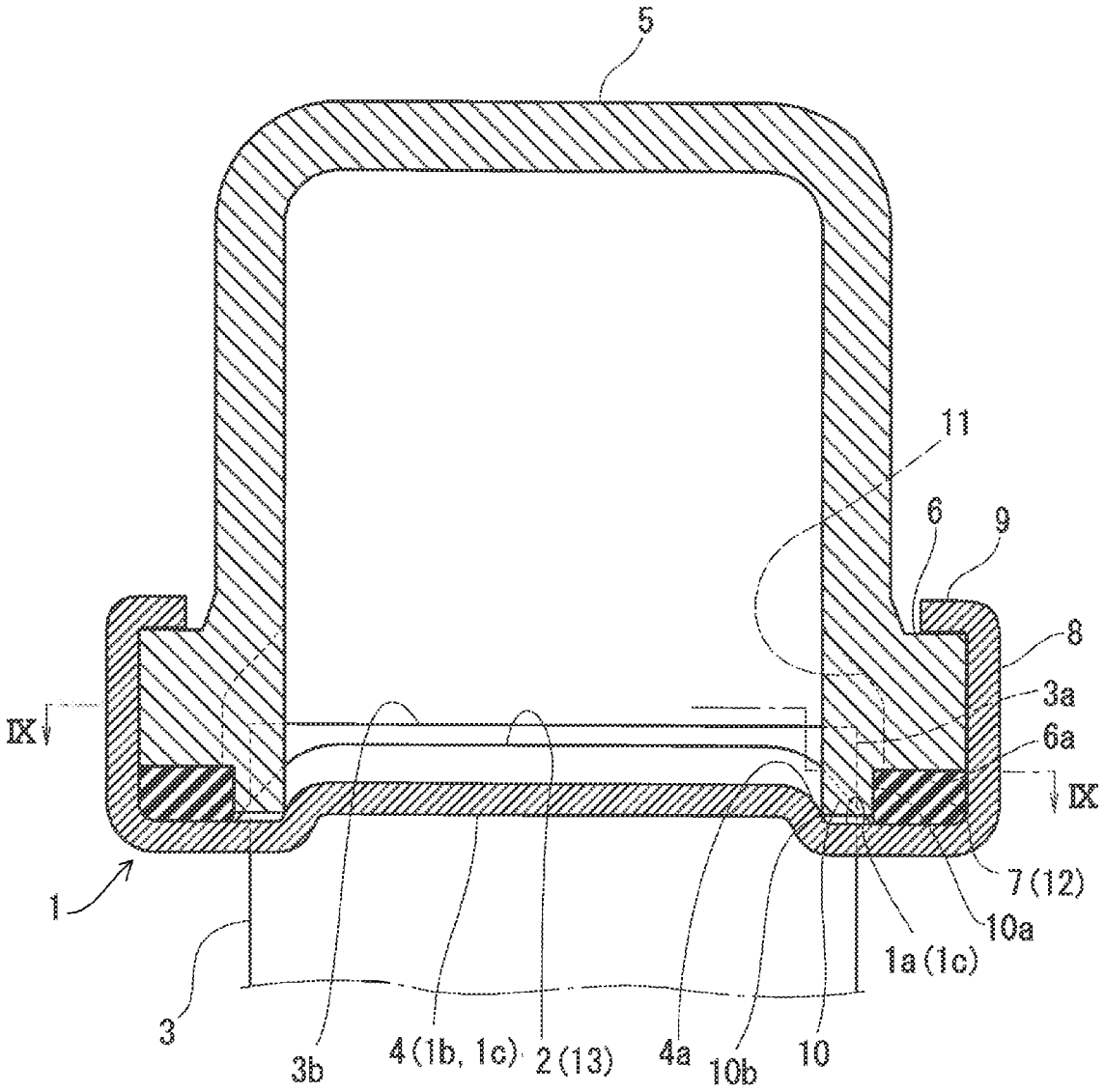
FIG. 7 illustrates a main part transverse sectional view of a heat exchanger in a second Example of the invention.

A difference from the first Example is, as illustrated in FIG. 7, a point that the packing 7 contacts the tooth part 10 of the tank body 5. Moreover, a characteristic thereof is an assembling method enabling easy assembling, by fitting the packing 7 in advance, as illustrated in FIG. 8, to the side face 10*a* of the outer periphery of the tooth part 10 of the tank body 5, upon assembling thereof.

The structure of the tank body 5 and the structure of the header plate 1 are the same as those in the first Example, and, therefore, explanation is omitted.

Figure 8:
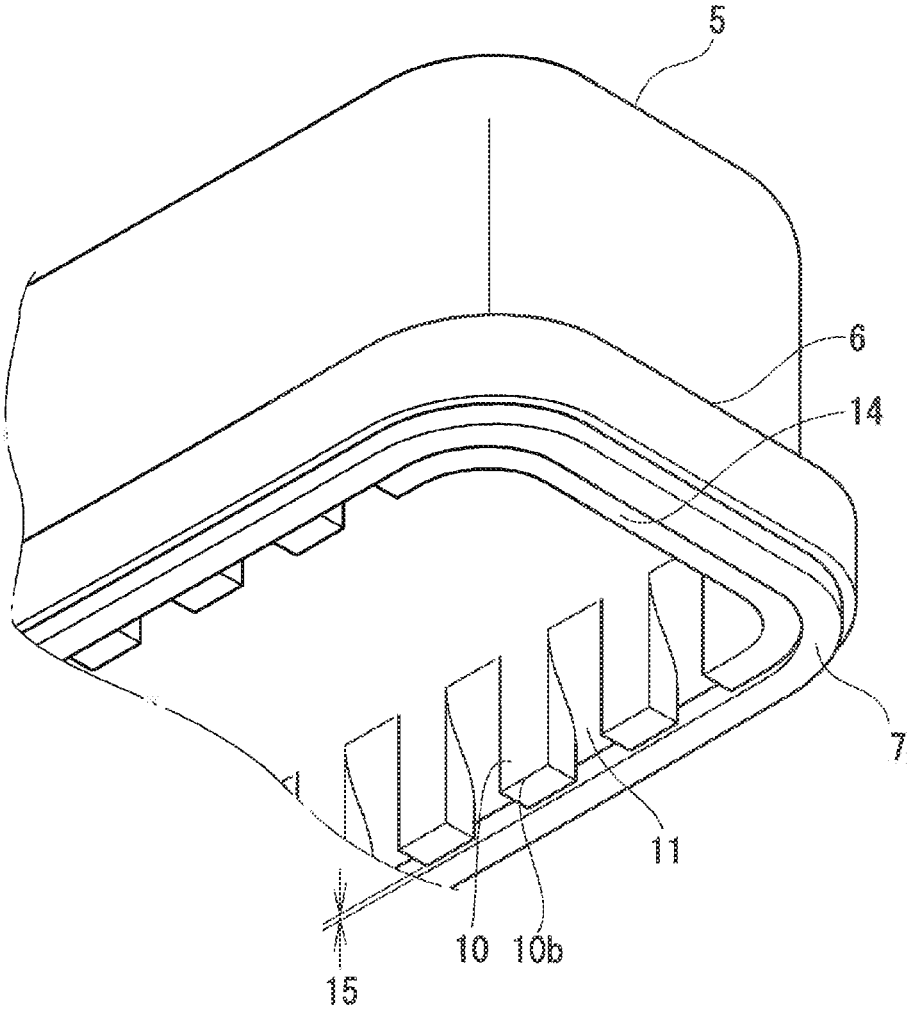
FIG. 8 illustrates a perspective view showing a state where a packing 7 is mounted on the outer periphery of a tooth part 10 in FIG. 7 and an arc-like tooth part 14.

In the second Example, as illustrated in FIG. 8, for the step formed from the end face 6*a* of the flange part 6 and the tooth part 10 of the tank body 5, and the side face 10*a* on the outer side of the arc-shaped tooth part 14, in advance the annular packing 7 is fitted, in a stretched state, to the inner periphery thereof. At this time, the packing 7 protrudes slightly by the magnitude of step 15 to the lower side of the tooth part 10 and the tip face of the arc-shaped tooth part 14.

Figure 9:
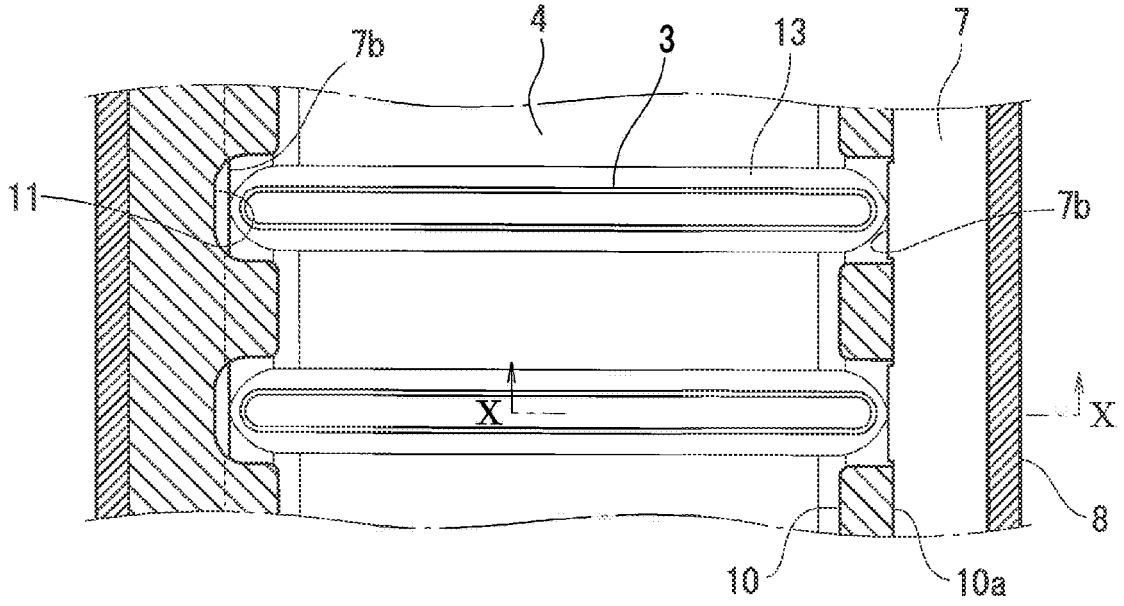
FIG. 9 illustrates a view seen along the IX-IX arrow in FIG. 7.
Figure 10:
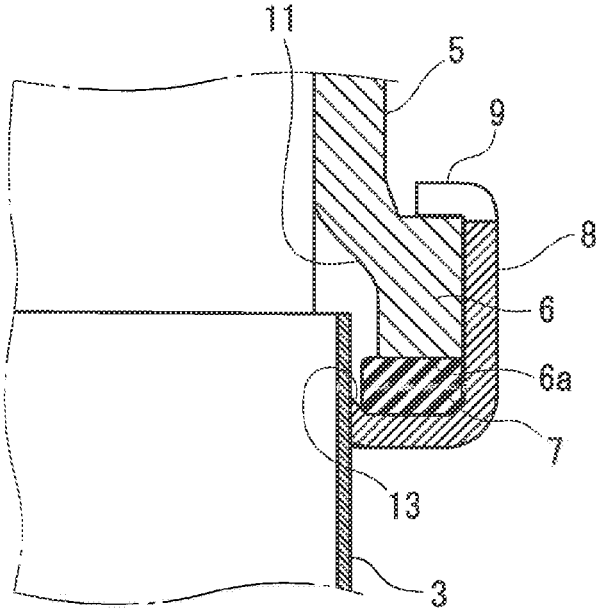
FIG. 10 illustrates a cross-sectional view seen along the X-X arrow in FIG. 9.

In the state, in the case where the tank body 5 is fitted onto the header plate 1 and pressed, the magnitude of the step 15 is pressed and, as illustrated in FIGS. 9 and 10, the inner periphery 7*b* of the packing 7 is pushed out to be abutted on the side edge on the longer axis side of the rim wall 13 of the tube insertion hole 2 of each flat tube 3, and the packing 7 is positioned. In the state, the caulking claw 9 of the peripheral wall 8 is caulked to the flange part 6 of the tank body 5, and the tank body 5 and the core are fixed to each other.

In the above-described two Examples, the explanation is given on the basis of the example in which the rim wall 13 is provided at the hole edge of the tube insertion hole 2, but it is also possible to insert the flat tube 3, without providing the rim wall 13, into the header plate 1. In this case, the inner periphery of the packing 7 can also be contacted to the side edge 3*a* of the inserted end part of the flat tube 3 to position the packing 7.

Moreover, in the drawings, such a configuration is illustrated that the tube end release part 11 is recessed so that the transverse section has a reverse "J-like" shape without the head portion, but, if a shape allows a tube edge to be inserted reasonably, the above-described shape is not limitative.

(Another Example of Shape of Convex Part 4 of Header Plate 1)

Figure 11:
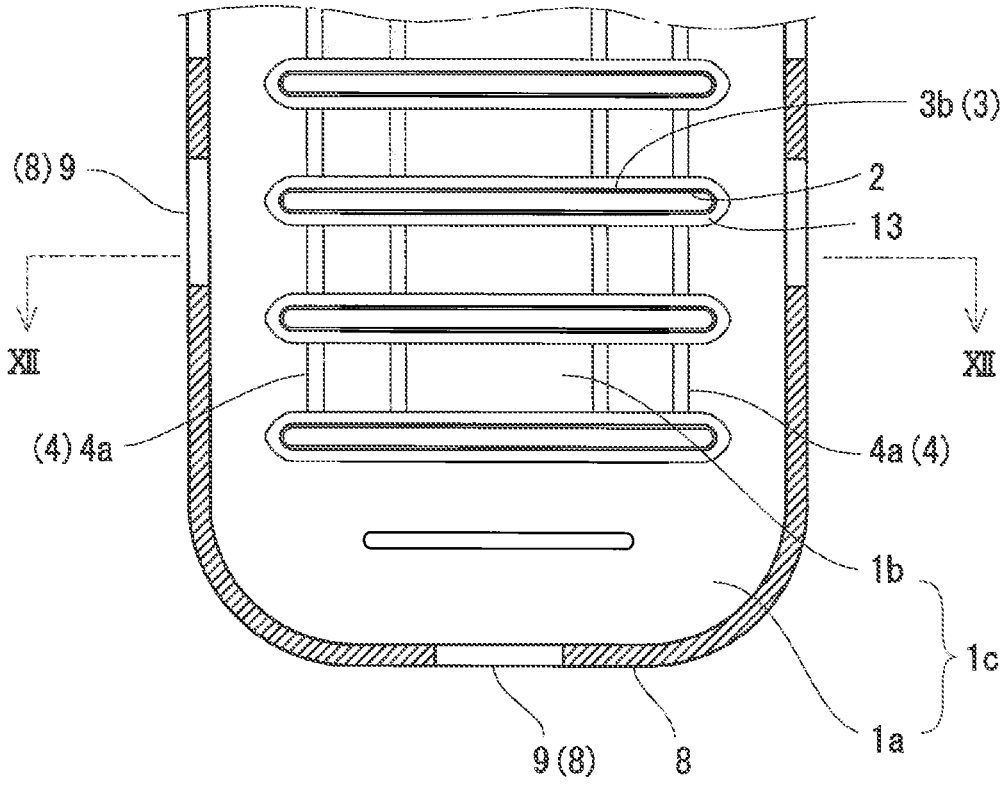
FIG. 11 illustrates a main part plan view showing another example 1 of the header plate 1 for use in a heat exchanger of the present invention.
Figure 12:
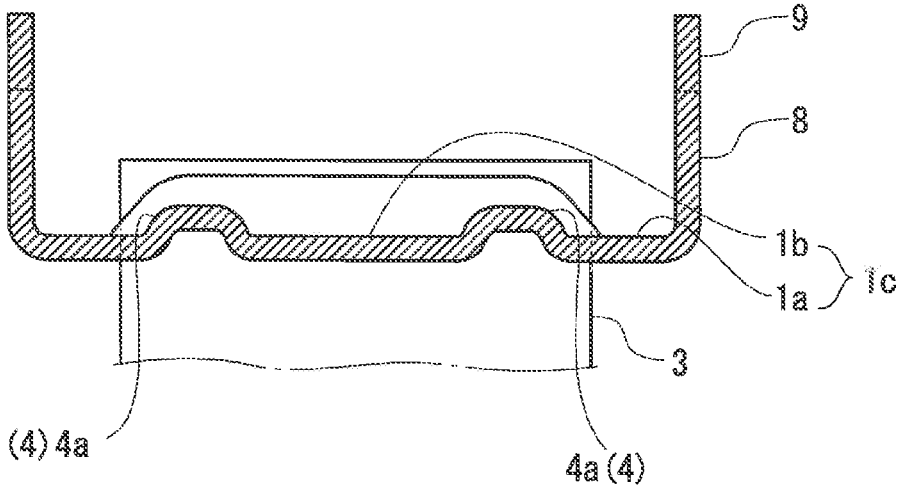
FIG. 12 illustrates a view seen along the XII-XII arrow in FIG. 11.
Figure 13:
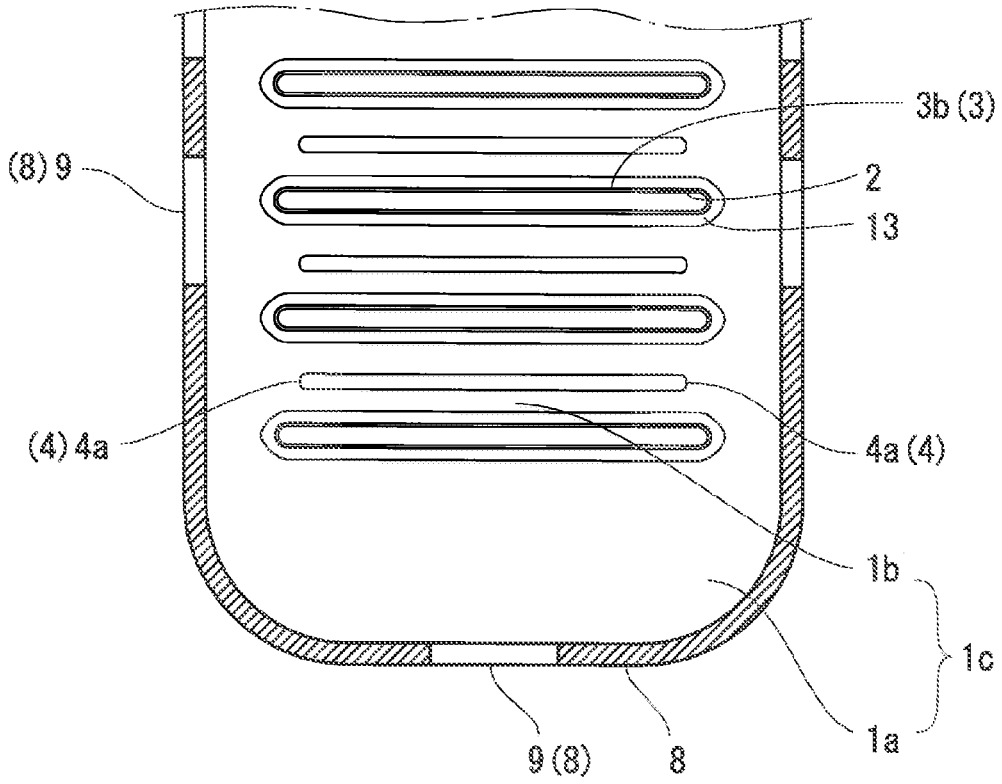
FIG. 13 illustrates a main part plan view showing another example 2 of the header plate 1 for use in a heat exchanger of the present invention.
Figure 14:
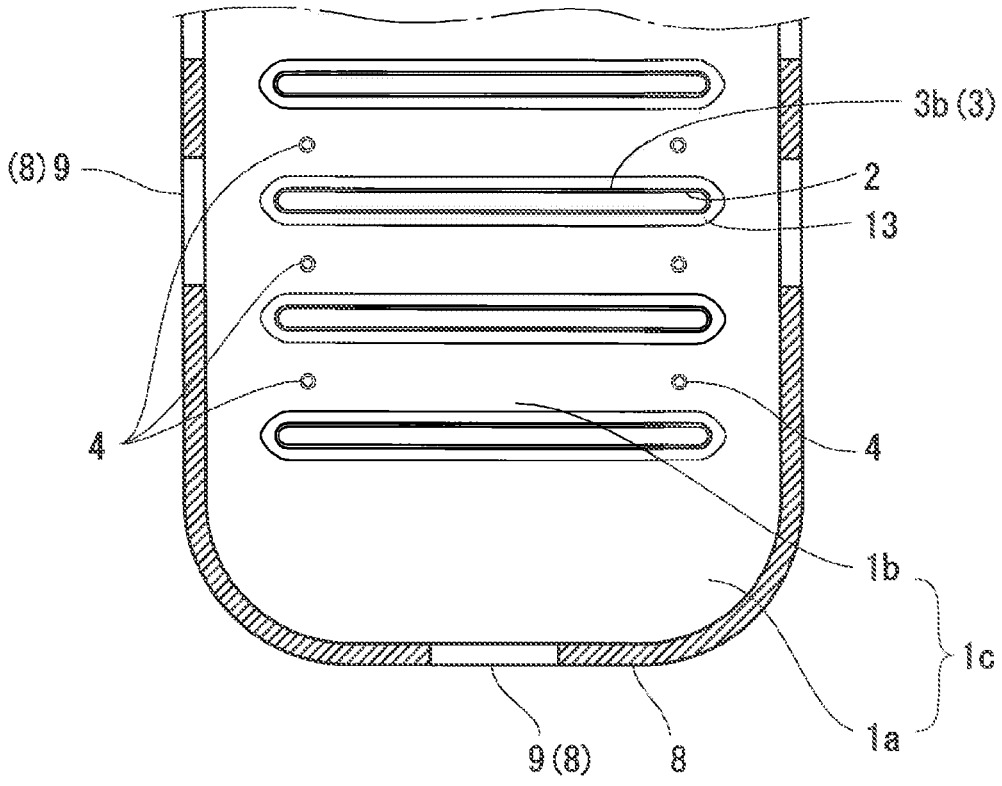
FIG. 14 illustrates a main part plan view showing another example 3 of the header plate 1 for use in a heat exchanger of the present invention.
Figure 15:
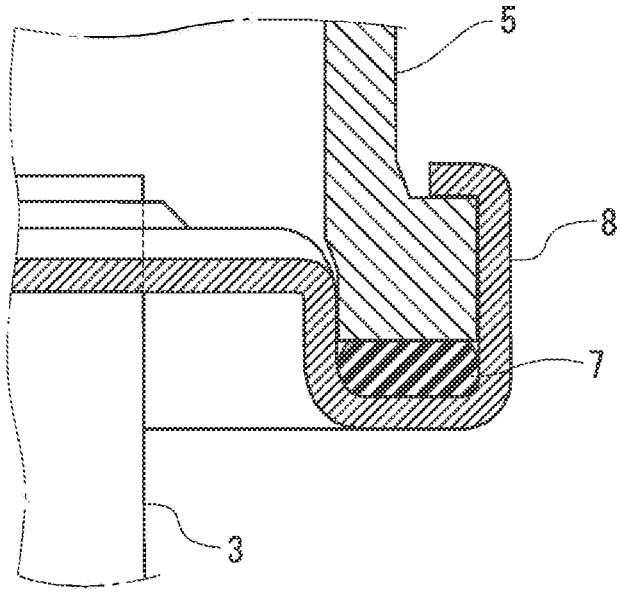
Fig.15 PRIOR ART
FIG. 15 illustrates a main part transverse sectional view of a conventional type heat exchanger.

In addition, the shape of the convex part 4 of the header plate 1 can be set, as illustrated in FIGS. 11 and 12, to a projection linearly extending between the tube insertion holes 2. Moreover, as illustrated in FIG. 13, the shape can also be set to a linear projection extending in the parallel direction of the tube insertion holes 2. Furthermore, as illustrated in FIG. 14, by providing dimple-shaped projections to form the convex part 4, displacement of the tooth part 10 of the tank body 5 can also be prevented.

The shape of the convex part 4 provided for the header plate 1 may be a shape that exerts the effect of the convex part 4 of the present invention (at least a function of preventing displacement of the tooth part 10 of the tank body 5), and the above-described Examples are not limitative.

The invention claimed is:

1. A heat exchanger comprising:

a header plate and a plurality of flat tubes, the header plate having tube insertion holes which receive end portions of the flat tubes with the tubes arranged orthogonally to the header plate and spaced from one another in a longitudinal direction of the header plate, the flat tubes having sides comprising mutually opposed flat faces and longitudinal edges connecting the sides, and a cross-section of greater dimension parallel to the flat faces and of lesser dimension orthogonal to the flat faces, the tubes being arranged so that the spaces between the tubes are spaces between the tube sides comprising flat faces; and a resin tank body fixed to the header plate at an opening of the tank body via an annular packing, wherein:

the header plate includes a bottom part provided with a seal face with which the annular packing makes contact and also provided with a tube insertion hole face in which the tube insertion holes are formed;

the header plate includes a peripheral wall and caulking claws extending upward from an outer peripheral edge of the bottom part;

the tube insertion hole face includes a face of a convex part or respective faces of each of two mutually parallel convex parts of the bottom part of the header plate protruding in a same direction as the direction of the upward extending of the peripheral wall and extending in a lengthwise direction of the tubes over a range up to a vicinity of but not including respective end openings of the tubes;

the bottom part of the header plate includes a concave part contiguous with the convex part or the two mutually parallel convex parts and circumscribing the convex part or the two mutually parallel convex parts and receding in a direction opposite the direction of the upward extending of the peripheral wall, the concave part comprising the seal face;

the convex part or each of the two mutually parallel convex parts of the bottom part of the header plate has an outer peripheral side edge at a juncture thereof with the concave part of the bottom part of the header plate; and the tank body comprises:

an annular flange part at a periphery of the opening of the tank body, and a plurality of tooth parts protruding from an end face of the flange part along an inner periphery of the flange part, the tooth parts being spaced from each other and facing the seal face of the header plate;

tube end release parts formed between adjacent pairs of the tooth parts and recessed so that, proximate the tube openings, longitudinal edges of the tubes are disposed closer than inner peripheries of the tooth parts to the peripheral wall of the header plate; and a part for accommodating the annular packing, the packing accommodation part being formed by an outer side face of each of the tooth parts and an end face of the flange part and an inner peripheral face of the peripheral wall;

wherein:

only an inside tip edge of each of the tooth parts is seated on the outer peripheral side edge of the convex part or one or the other of the two mutually parallel convex parts of the bottom part of the header plate; and the annular packing is arranged between the packing accommodation part and the seal face, and the tank body is fixed to the header plate by the caulking claw.

2. The heat exchanger according to claim 1, wherein the protrusion of the convex part is in a direction parallel to longitudinal axes of the tube insertion holes.

3. The heat exchanger according to claim 1, wherein a gap is present between the outer side face of each of the tooth parts and the annular packing.

4. The heat exchanger according to claim 3, wherein at edges of the tube insertion holes protective walls for the tube ends are formed extending upward in the direction in which the peripheral wall extends upward, and the annular packing is positioned adjacent longitudinal edges of the protective walls.

5. The heat exchanger according to claim 1, wherein the recess of each of the tube end release parts, in transverse section thereof, curves gradually so that the recess is deepest adjacent the packing and gradually becomes more shallow in a direction away from the annular packing.

6. A method for assembling the heat exchanger according to claim 1, comprising:

stretching the annular packing so that the stretched annular packing contacts and is thereby mounted onto the outer side face of each of the tooth parts of the tank body, and then fitting the opening of the tank body onto the seal face of the header plate; and subsequently, caulking and fixing the tank body to the header plate with the caulking claws.

* * * * *